US006774861B2

(12) United States Patent
Choung et al.

(10) Patent No.: US 6,774,861 B2
(45) Date of Patent: Aug. 10, 2004

(54) DUAL BAND HYBRID OFFSET REFLECTOR ANTENNA SYSTEM

(75) Inventors: Youn H. Choung, Rolling Hills Estates, CA (US); George H. Simkins, Torrance, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 0 days.

(21) Appl. No.: 10/174,683

(22) Filed: Jun. 19, 2002

(65) Prior Publication Data

US 2003/0234745 A1 Dec. 25, 2003

(51) Int. Cl.[7] ..... H01Q 13/00
(52) U.S. Cl. ..... 343/781 CA; 343/909
(58) Field of Search ..... 343/753, 754, 343/781 CA, 781 P, 781 R, 840, 909

(56) References Cited

U.S. PATENT DOCUMENTS 4,342,036 A * 7/1982 Scott et al. ..... 343/836
5,130,718 A * 7/1992 Wu et al. ..... 343/781 CA
5,394,163 A * 2/1995 Bullen et al. ..... 343/771
5,859,619 A 1/1999 Wu et al.
6,198,457 B1 * 3/2001 Walker et al. ..... 343/840
6,342,865 B1 * 1/2002 Chandler et al. ..... 343/781 CA
6,545,645 B1 * 4/2003 Wu ..... 343/781 P

* cited by examiner

*Primary Examiner*—Tho Phan
(74) *Attorney, Agent, or Firm*—Posz & Bethards, PLC

(57) ABSTRACT

A dual band high efficiency hybrid offset reflector antenna system (10) that includes a low frequency antenna (12, 16) including a paraboloidal main offset reflector (12) for reflecting a low frequency signal, as well as a high frequency antenna (12, 14, 18) including both the main offset reflector (12) and a hyperboloidal subreflector (14) for reflecting a high frequency signal discrete from the low frequency signal. The hyperboloidal subreflector (14) includes a frequency selective surface (33) that passes the low frequency signal reflected by the paraboloidal main offset reflector (12) with low subreflector diffraction loss, and that is highly reflective at the high frequency. Offset beam squint pointing error can be eliminated because the high and low frequency bands have separate feed focal locations **(30*a*, 30*b*)**.

16 Claims, 10 Drawing Sheets

| Horn Element Dimensions (Inches) | Feed Horn 16 (EHF Horn) | Feed Horn 18 (SHF Horn) |
|---|---|---|
| Total Length | 5.35 | 7.75 |
| First Section Aperture Diameter | 1.74 | 1.50 |
| First Section Length | 2.20 | 2.90 |
| Second Section Length | 2.00 | 2.75 |
| Third Section Length | 1.15 | 2.10 |
| Third Section Length (Flared Section) | 0.85 | 1.80 |
| Third Section Length (Straight Section) | 0.30 | 0.30 |
| Third Section Aperture Diameter | 0.52 | 0.25 |
| Feed Illumination Edge Angle $\alpha$ | 24.88° | 13.45° |
| Feed Tilt Angle $\beta$ With Respect to Focal Axis | 39.13° | 20.42° |

Figure 8

| | | SHF | EHF |
|---|---|---|---|
| **Frequency** | **GHz** | **20.7** | **44.5** |
| | Wavelength (Inch) | 0.570 | 0.265 |
| | Reflector Diameter (Inch) | 17.6 | 17.6 |
| **Gain** | **Ideal (dBi)** | **39.73** | **46.38** |
| **Loss** | **Illumination (dB)** | **-0.70** | **-1.01** |
| | **Spillover (dB)** | **-0.36** | **-0.18** |
| | **Subreflector Diffraction** | | **-0.23** |
| | **FSS Subreflector Loss** | **-0.3** | **-0.25** |
| | **Feed** | **-0.22** | **-0.27** |
| | Horn | -0.05 | -0.05 |
| | Polarizer/Transition | -0.15 | -0.2 |
| | VSWR (1.12:1) | -0.02 | -0.02 |
| | **Reflector RMS (3 mil)** | **-0.02** | **-0.08** |
| **Total Loss** | **(dB)** | **-1.60** | **-2.02** |
| | (%) | 69.18 | 62.81 |
| **Net Gain** | **(dBi)** | **38.13** | **44.36** |

Figure 13

DUAL BAND HYBRID OFFSET REFLECTOR ANTENNA SYSTEM

FIELD OF THE INVENTION

This invention relates generally to antennas and, more particularly, to a small size, high efficiency dual band antenna system that includes both a single reflector low frequency antenna and a dual reflector high frequency antenna and that is constructed in a manner that minimizes squint beam pointing error between the two frequency bands.

BACKGROUND

Conventional satellite communications applications require the use of highly directional dual band antennas to transmit and receive microwave signals between orbiting satellites or between an orbiting satellite and a ground-based uplink. In applications requiring high antenna efficiency, a dual-band antenna system using two separate antennas and two separate antenna feeds may be used. However, such a system is impractical in the above-mentioned satellite communications applications, as it is expensive to implement due to component redundancies and requires a relatively large amount of real estate.

Low data rate link antenna systems such as those with a conventional Cassegrain geometry offer one solution to the above-mentioned real estate and cost issues associated with the dual antenna/dual feed configuration. In a Cassegrain antenna system, a parabolic reflector acts as the primary reflector, and a smaller hyperbolic subreflector deflects incoming microwaves to a signal feed located at or near the center of the reflector. However, the subreflector can only be about 5 wavelengths (relative to the lower frequency band) in size due to the size of the dual frequency antenna aperture in a Cassegrain antenna system. This small size results in high subreflector diffraction loss for the lower frequency band. Consequently, such a system is too inefficient for most commercial and military satellite applications.

A low data rate link antenna having a small single reflector with a dual frequency feed offers another commercially viable solution to the above-mentioned real estate and cost issues associated with the dual antenna/dual feed antenna systems. However, as with the Cassegrain antenna system, a single reflector/dual frequency feed antenna system is complex to build and is inefficient due to high feed insertion loss. In addition, a single reflector/dual frequency feed system has a high associated defocus loss caused by phase center offset even though the horn shape dimensions are mechanically the same for both the low and the high frequency bands but electrically different due to the different wavelengths between the two bands. For circular polarization, this antenna has offset beam squint pointing error between the high and low frequency bands because the beam squint is frequency dependent even though the offset reflector has the same focal point for both frequency bands. Consequently, such an antenna system typically has less than 50% antenna efficiency and a high axial ratio for each frequency band, and is limited in its RF high power capability.

Accordingly, an object of the present invention is to provide a high efficiency dual band antenna system that is small in size and that has a feed design that is of minimal mechanical complexity.

A further object of the present invention is to provide a high efficiency dual band antenna system that is constructed so that both the high and the low frequency bands have optimum phase centers and so that the gain of the low and high frequency feeds is maximized.

A further object of the present invention is to provide a high efficiency dual band antenna system in which both antennas have low feed loss and good axial ratio, and in which the antennas are configured to eliminate beam squint pointing error between the high and low frequency bands.

SUMMARY OF THE INVENTION

Accordingly, the present invention provides an antenna system that includes a paraboloidal main offset reflector for reflecting a low frequency signal as well as a high frequency antenna including both the main offset reflector and a hyperboloidal subreflector for reflecting a high frequency signal discrete from the low frequency signal. The hyperboloidal subreflector includes a frequency selective surface for passing the low frequency signal reflected by the paraboloidal main offset reflector.

The antenna system according to the present invention is highly efficient and small in size compared to the above discussed conventional antenna systems, as the hyperboloidal subreflector essentially acts as a lowpass filter to transmit the low frequency signal with no subreflector diffraction loss and is highly reflective at the high frequency. Also, offset beam squint pointing error can be eliminated because the high and low bands have separate feed focal locations. In addition, overall system cost is reduced because, for example, loose tolerance smooth feed horns are used rather than the tight tolerance corrugated feed horns required in dual band antenna systems.

BRIEF DESCRIPTION OF THE DRAWINGS

Additional objects and advantages of the present invention will be more readily apparent from the following detailed description of preferred embodiments thereof when taken together with the accompanying drawings in which:

FIG. 8 is a table of feed horn dimensions for the antenna system shown in FIG. 1;

FIG. 13 is a table of antenna gain and loss parameters for the antenna system shown in FIG. 1.

DESCRIPTION OF THE PREFERRED EMBODIMENTS

Figure 1:
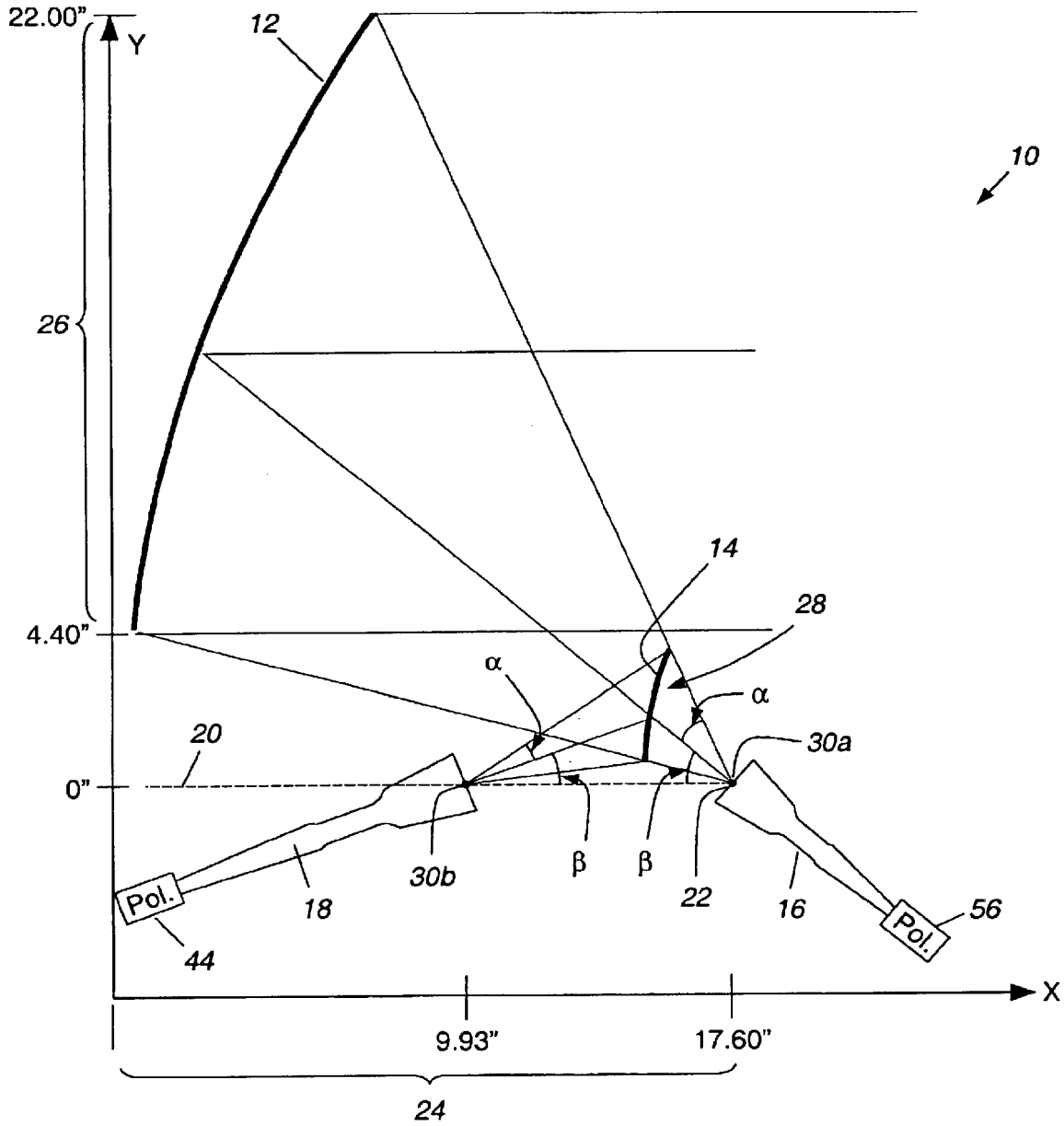
FIG. 1 is a side view of the antenna system according to a preferred embodiment of the present invention.

Referring now to the drawings in which like numerals reference like parts, FIG. 1 shows a dual band high efficiency hybrid offset reflector antenna system (antenna system) 10 according to a preferred embodiment of the present invention. The antenna system 10, which is for use in transmitting and receiving signals across inter-satellite communications links and between satellite antennas and ground-based antennas for uplinks and downlink communications, includes a main offset paraboloidal reflector (reflector) 12, a hyperboloidal subreflector (subreflector) 14, a first feed, such as a feed horn, 16 and a second feed, such as a feed horn, 18. As will be discussed below in detail, the reflector 12 and the feed horn 16 together form a low frequency antenna, while the reflector 12, the subreflector 14 and the feed horn 18 together form a high frequency antenna.

The paraboloidal reflector 12, which is shown along with the hyperboloidal subreflector 14 only in two-dimensional form for ease of illustration, has a focal axis 20, a focal point 22, and a focal length 24 defined by the distance between the focal point 22 and a vertex (0" in FIG. 1) of the reflector 12. Further, the reflector 12 has a radiating aperture defined generally at 26.

Referring to FIGS. 1 and 2A–2C, the subreflector 14 is located in front of the feed horn 16 and has a radiating aperture 28, a first focal point 30*a* that is coincident with the focal point 22 of the reflector 12, and a second focal point 30*b* that also lies on the focal axis 20 of the reflector 12 a predetermined distance from the first focal point 30*a*. Instead of reflecting a large portion of the low frequency signal transmitted by the feed horn 16, the subreflector 14 acts as a lowpass filter and thereby passes the low frequency signal transmitted from the feed horn 16 to the reflector 12.

Figure 2A:
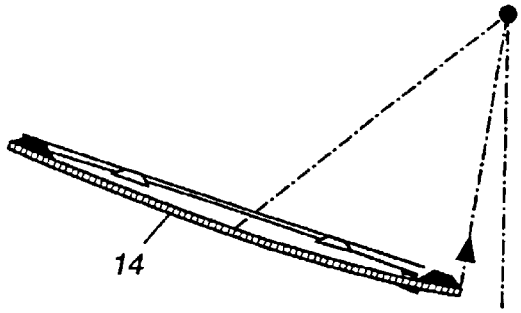
FIG. 2A is a cross-sectional side elevation view of the subreflector shown in FIG. 1.
Figure 2B:
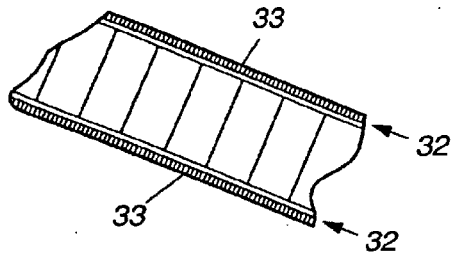
FIG. 2B is a partial cross-sectional view of the subreflector shown in FIG. 2.
Figure 2C:
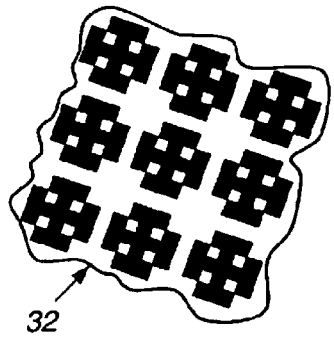
FIG. 2C is a top plan view of the dipole grid shown in FIG. 2B.

This is possible because, as shown in FIG. 2C, the subreflector 14 has top and bottom frequency selective surfaces 33 separated by Kevlar® honeycomb that reflects only the high frequency signal directed to the feed horn 18. The frequency selective surface 33 of the subreflector 14 preferably consists of a copper-etched dipole grid 32 on a multi-layer laminated Kevlar® surface. With such a configuration, the subreflector 14 passes the low frequency signal with low subreflector diffraction loss, is highly reflective with respect to the high frequency signal that it reflects to the feed horn 18, and is sized and positioned so that it does not block the incoming high frequency signal that is received at and reflected by the reflector 12.

Figure 3:
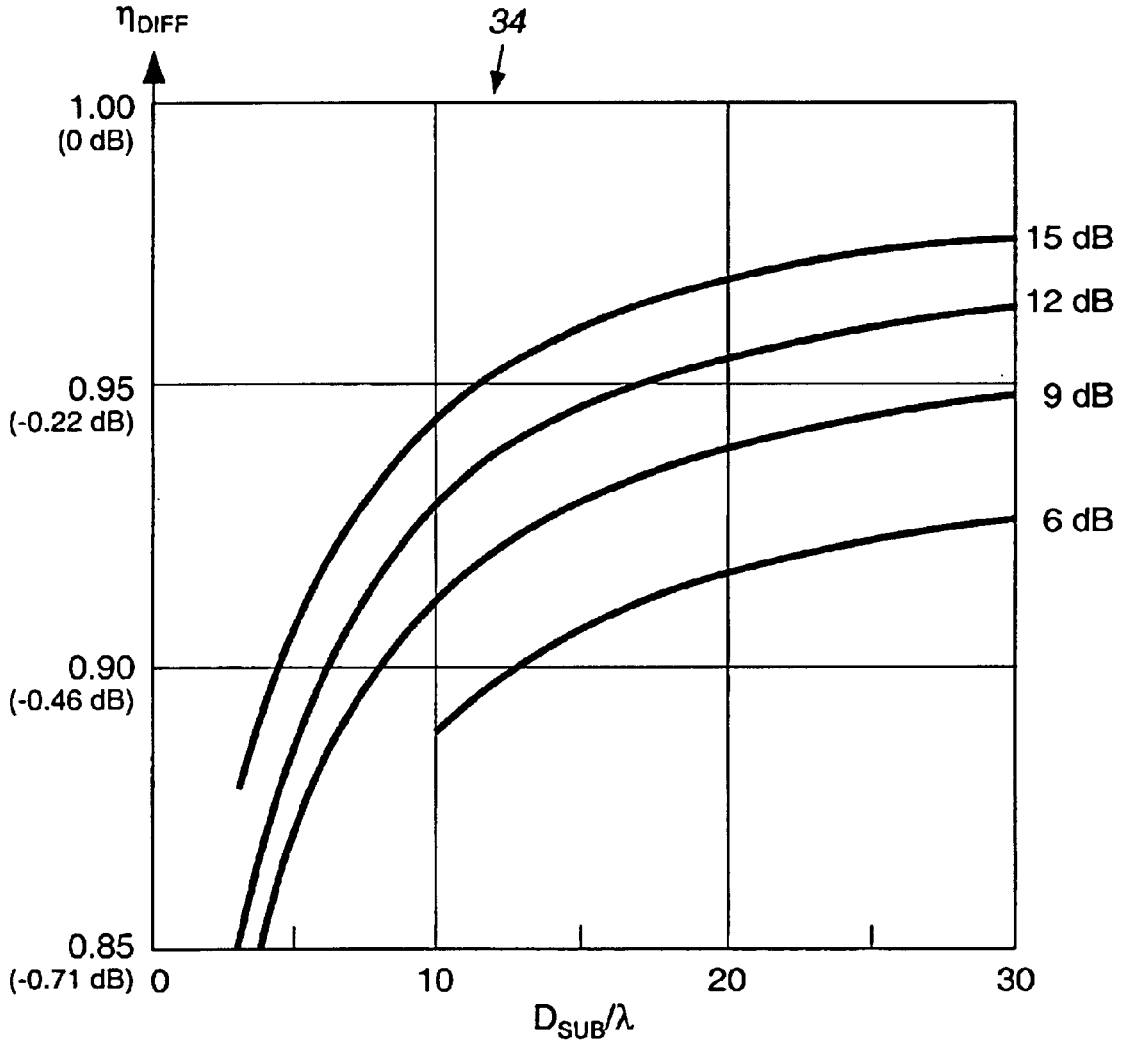
FIG. 3 is a graph of the diameter of the subreflector shown in FIG. 1 as divided by frequency band wavelength versus diffraction efficiency.

The subreflector 14 is designed to have a diameter that yields a high Gaussian feed taper and therefore a high diffraction efficiency with respect to the high frequency signal being received by the antenna system 10. FIG. 3 graphically shows at 34 antenna diffraction analysis results generated from user specific antenna software for subreflector diameter/signal wavelength normalized values ($D_{SUB}/\lambda$) for various Gaussian feed tapers for the feed horn 18. In the present exemplary embodiment, because a 10 to 12 dB feed edge taper is desired for the low frequency SHF signal for maximum gain, and because a compromise between subreflector diffraction loss and spillover/illumination loss caused by subreflector size must be made for the high frequency EHF signal in the design of the antenna system 10, a desired higher edge taper of about −15 dB represents a compromise between the low and high frequency signal requirements and at the same time minimizes the total amount of real estate needed to implement the subreflector 14. Given the above, the antenna diffraction analysis indicated that the subreflector 14 yielded acceptable results when it was designed so that $D_{SUB}/\lambda$ was in the range of approximately 10–20. The subreflector 14 yielded optimal results when it was designed so that $D_{SUB}/\lambda$ was in the range of 12–15, as diffraction efficiency $\eta_{DIFF}$ was at or higher than about 95%, with larger $D_{SUB}/\lambda$ values resulting in only incremental gains in $\eta_{DIFF}$.

In view of the above, it should be appreciated that the subreflector 14 is capable of having a diameter of, for example, about 10–20λ, and preferably about 12–15λ, with respect to the high frequency EHF signal, without the need for taking the size of the subreflector 14 with respect to the low frequency signal into consideration. This is because the subreflector 14 may be positioned as shown in FIG. 1 with respect to the reflector 12 and the feed horns 16, 18 so that it does not block incoming signals. Therefore, it can be sized to provide high reflectivity for the high frequency signal without sacrificing low frequency signal transmission efficiency, as is often the case in conventional dual band antenna configurations. In addition, the subreflector 14 enables the overall size and mechanical design complexity of the antenna system 10 to be minimized, as complex dual frequency feeds required in conventional dual band antenna systems are not necessary.

It is contemplated that the low frequency signal transmitted by the feed horn 16 is a satellite communications signal in the SHF band (18–30 GHz), while the high frequency signal received by the feed horn 18 is a satellite communications signal in the EHF band (30–60 GHz). More specifically, it is contemplated that the antenna system 10 is for use in a satellite environment such as the United States Air Force MilStar Distributed User Coverage Antenna (DUCA) environment in which communications signals in the range of 20–44 GHz are transmitted and received, and in which low frequency signals typically fall within a frequency band of 20.2 GHz–21.2 GHz and high frequency signals typically fall within a frequency band of 43.5 GHz–45.5 GHz. Therefore, the exemplary design parameters provided and discussed herein are specific to that application unless otherwise indicated. However, it will be appreciated by those skilled in the art that the antenna system 10 can be designed to accommodate any dual band signal communications application in which system real estate and system efficiency are crucial such as, for example, discrete low and high frequency C band (4–6 GHz), Ku band (10–14 GHz) and Ka band (20–30 GHz) signals. Further, while the feed horn 16 is described as transmitting a low frequency signal and the feed horn 18 is described as receiving a high frequency signal, it should be appreciated that the antenna system is designed so that the feed horn 16 may alternatively be for receiving a low frequency signal while the feed horn 18 may alternatively be for transmitting a high frequency signal without changing the scope of the present invention if the antenna system 10 is used, for example, to establish ground-based satellite uplinks.

For the present exemplary antenna system 10 shown in FIG. 1 in which a low frequency SHF band signal and a high frequency EHF band signal are transmitted or received, the reflector 12 preferably has an aperture 26 of 17.6" and a focal length 24 of 17.6", while the subreflector 14 preferably has a diameter of 3.3", an eccentricity of 2.9, and first and second focal points 30*a*, 30*b* that are both located on the focal axis 20 of the reflector 12 and spaced 7.667" apart from one another. Of course, these design parameters will vary depending upon the specific intended implementation and the intended signal frequency bands.

Figure 4:
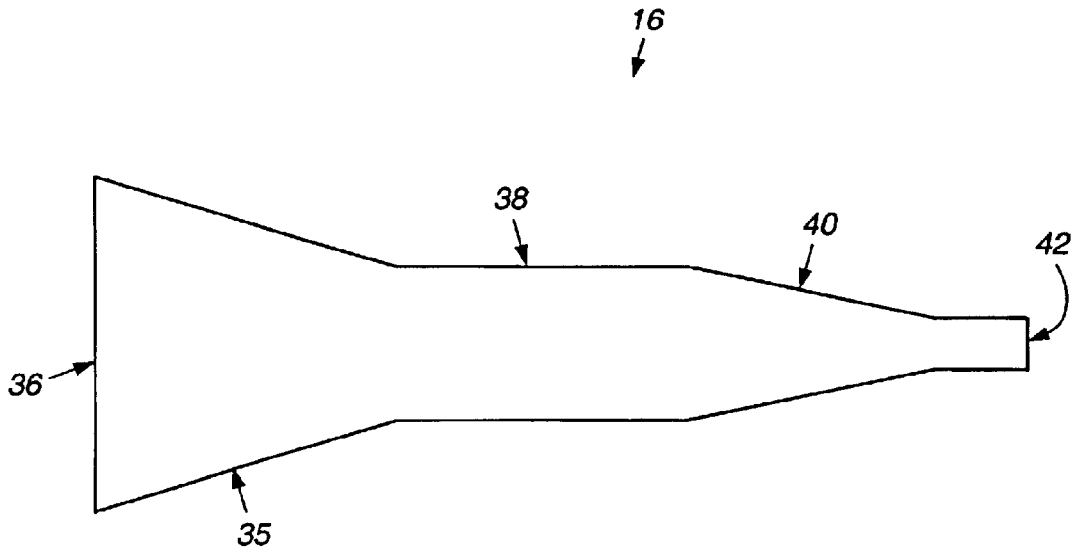
FIG. 4 is a side elevation view of a low frequency feed horn utilized in the antenna system shown in FIG. 1.
Figure 5:
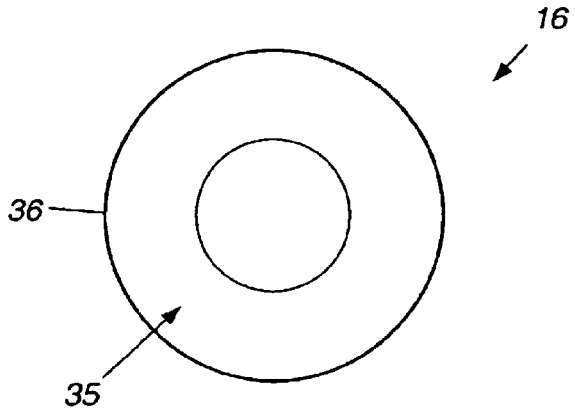
FIG. 5 is a front elevation view of the first flared section of the low frequency feed horn in FIG. 3.

Referring now to FIGS. 4 and 5, the feed horn 16 is a three section horn including a smooth walled, flared first section 35 with an aperture 36 for receiving or transmitting a circularly polarized low frequency signal, depending upon the particular application. The feed horn 16 also includes a straight second midsection 38 and a flared third section 40 with an aperture 42 for feeding the low frequency signal either to the smooth walled, flared first section 35 for signal transmission to a narrow band, high performance circular polarizer 44 (FIG. 1) for generating a circularly symmetric feed pattern in a manner well known in the art. Because the feed horn 16 is used in conjunction with the above-described circular polarizer 44, it has a low associated axial ratio. In addition, the feed horn 16 is designed to have a phase center at the horn aperture 36, and thus horn alignment with respect to the reflector 12 is simplified. Because the aperture 36 of the smooth walled, flared first section 35 is placed at the focal point 22 of the reflector 12, it achieves maximum antenna gain for the low frequency signal.

Figure 6:
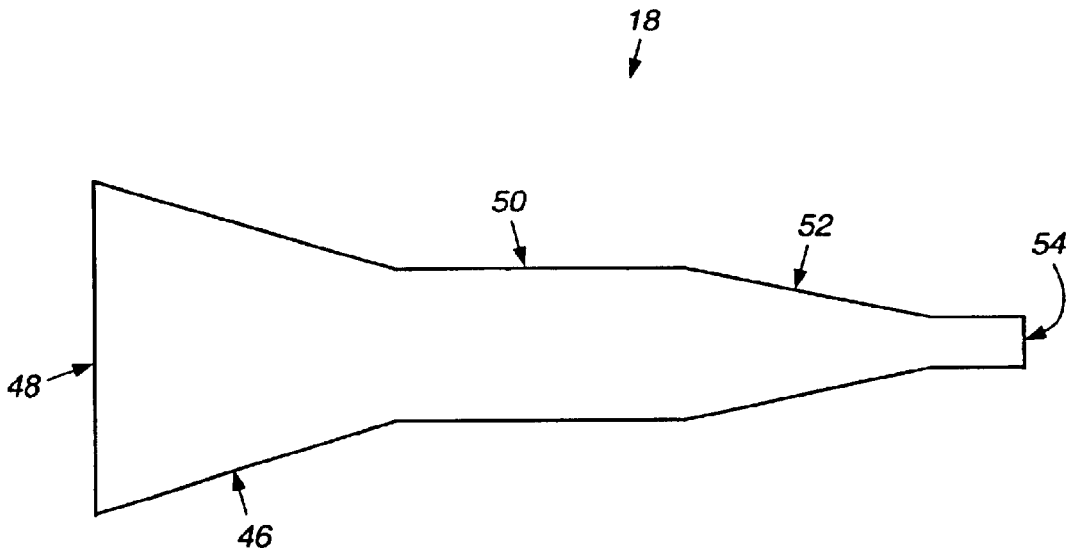
FIG. 6 is a side elevation view of a high frequency feed horn utilized in the antenna system shown in FIG. 1.
Figure 7:
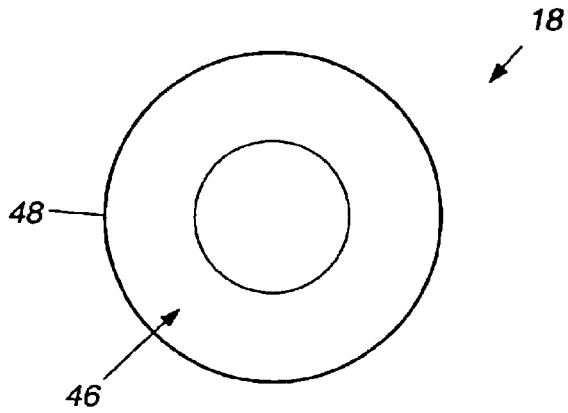
FIG. 7 is a front elevation view of the first flared section of the high frequency feed horn in FIG. 5.

Referring now to FIGS. 6 and 7, the feed horn 18 is a three section horn including a smooth walled, flared first section 46 with an aperture 48 for receiving or transmitting a circularly polarized high frequency signal depending upon the particular application. The feed horn 18 also includes a straight second midsection 50, and a flared third section 52 with an aperture 54 for feeding the high frequency signal either to the first flared section 46 for signal transmission or to a narrow band, high performance circular polarizer 56 (FIG. 1) for generating a circularly symmetric feed pattern in a manner well known in the art. Because the feed horn 18 is used in conjunction with the above-described circular polarizer 56, it has a low associated axial ratio. In addition, the feed horn 18 is also designed to have a phase center at the aperture 48, thereby enabling it to be easily aligned with the subreflector 14. Because the aperture 48 of the smooth walled, flared first section 46 is placed at the second focal point 30*b* of the subreflector 14, it achieves maximum antenna gain for the low frequency signal.

For the above-discussed exemplary antenna system 10 in which a low frequency SHF signal and a high frequency EHF signal are transmitted or received, the feed horns 16, 18 preferably have the dimensions shown in the table in FIG. 8. However, one skilled in the art will appreciate that such values may change depending upon the particular transmit/receive signal frequencies. Regardless, the feed horns 16, 18 are smooth walled and therefore simple in design and easy to machine with about 2 mil (0.002 inch) tolerance, yet they are capable of generating multiple modes for circularly symmetric radiating patterns. The feed horns 16, 18 therefore represent an improvement over conventional tight tolerance corrugated horns. Further, because the feed horns 16, 18 are capable of being individually positioned, beam squint pointing error due to the asymmetry of the reflector 12 and the transmitted/received circularly polarized signals can be tuned out for both the high and the low frequency signals.

Figure 9:
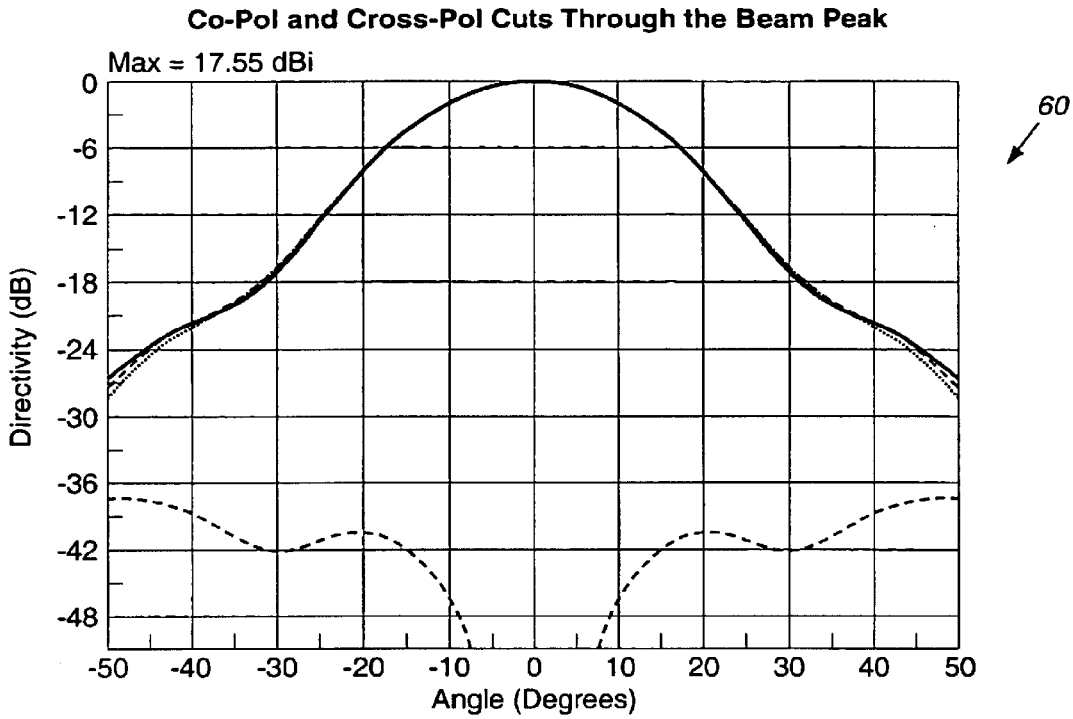
FIG. 9 is a graph of angle versus directivity of a pattern of the low frequency feed horn shown in FIGS. 1, 3 and 4.

FIG. 9 graphically shows at 60 an SHF signal feed pattern generated by the above-discussed antenna software modeling program, including beam directivity versus beam angle for a 20.7 GHz SHF signal reflected from the reflector 12. As the reflector 12 is designed to have a Gaussian edge taper of about −12 dB for maximum low frequency signal gain, the beam angle $\alpha$ as shown in FIG. 1 was about 25° at −12 dB, thereby resulting in almost complete reflection of the low frequency signal at the reflector 12.

Figure 10:
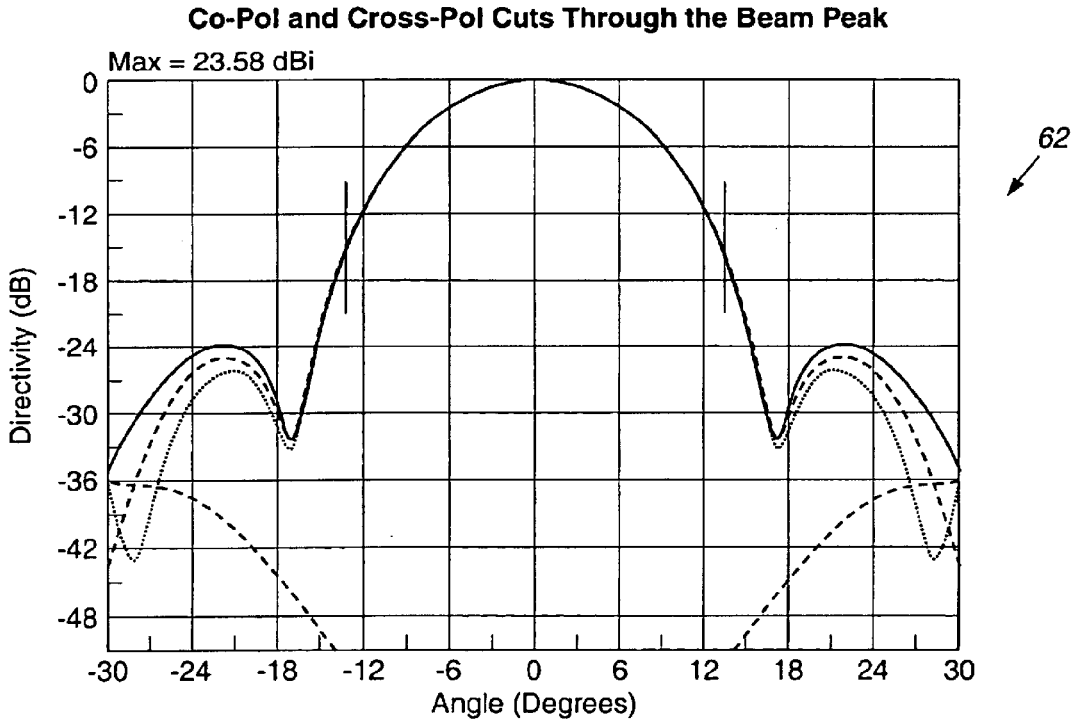
FIG. 10 is a graph of angle versus directivity of a pattern of the high frequency feed horn shown in FIGS. 1, 5 and 6.

Similarly, FIG. 10 graphically shows at 62 a resulting EHF feed pattern generated by an antenna software-modeling program, including beam directivity versus beam angle for a 44.5 GHz EHF signal reflected from the reflector 12. As the subreflector 14 is also designed to have a Gaussian edge taper of −15 dB for this high frequency signal and to act as a lowpass filter for the low frequency signal, at −15 dB the beam angle $\alpha$ as shown in FIG. 1 was about 13.5°, thereby resulting in almost complete reflection of the high frequency signal. The subreflector 14 remains over 95% efficient in reflecting the high frequency signal even at its outermost edges, thereby minimizing illumination and spillover loss.

Figure 11:
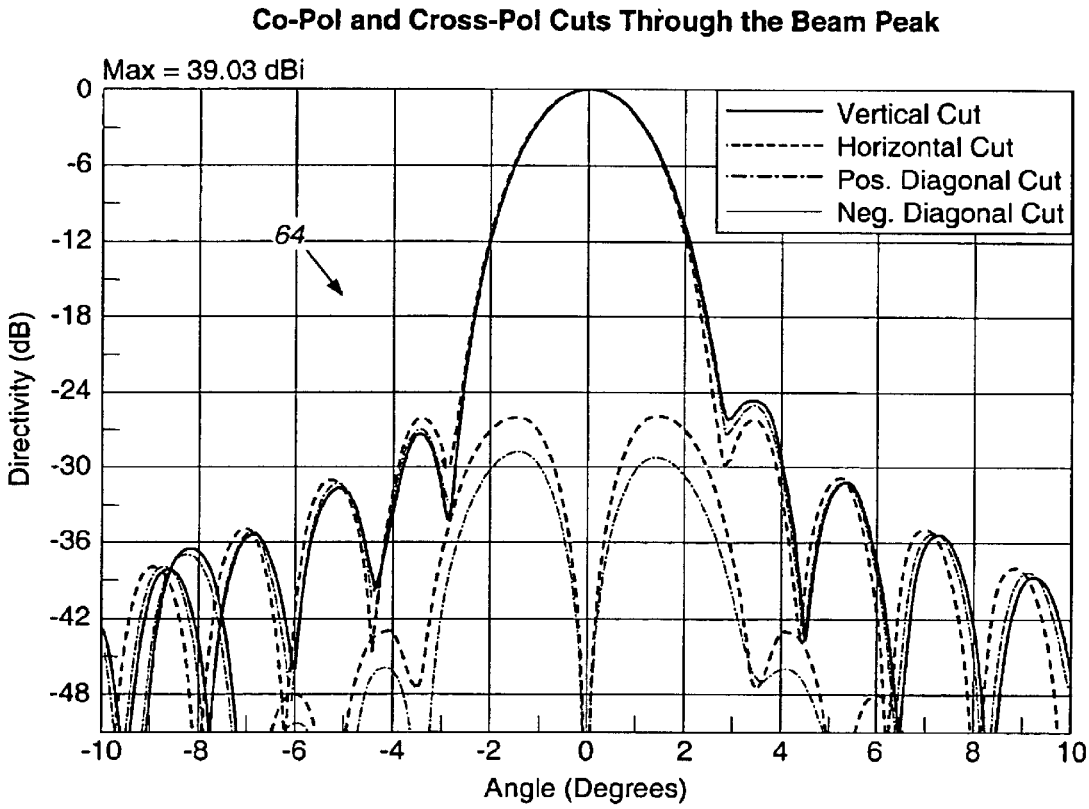
FIG. 11 is a graph of angle versus directivity of a radiation pattern of the low frequency antenna shown in FIG. 1.
Figure 12:
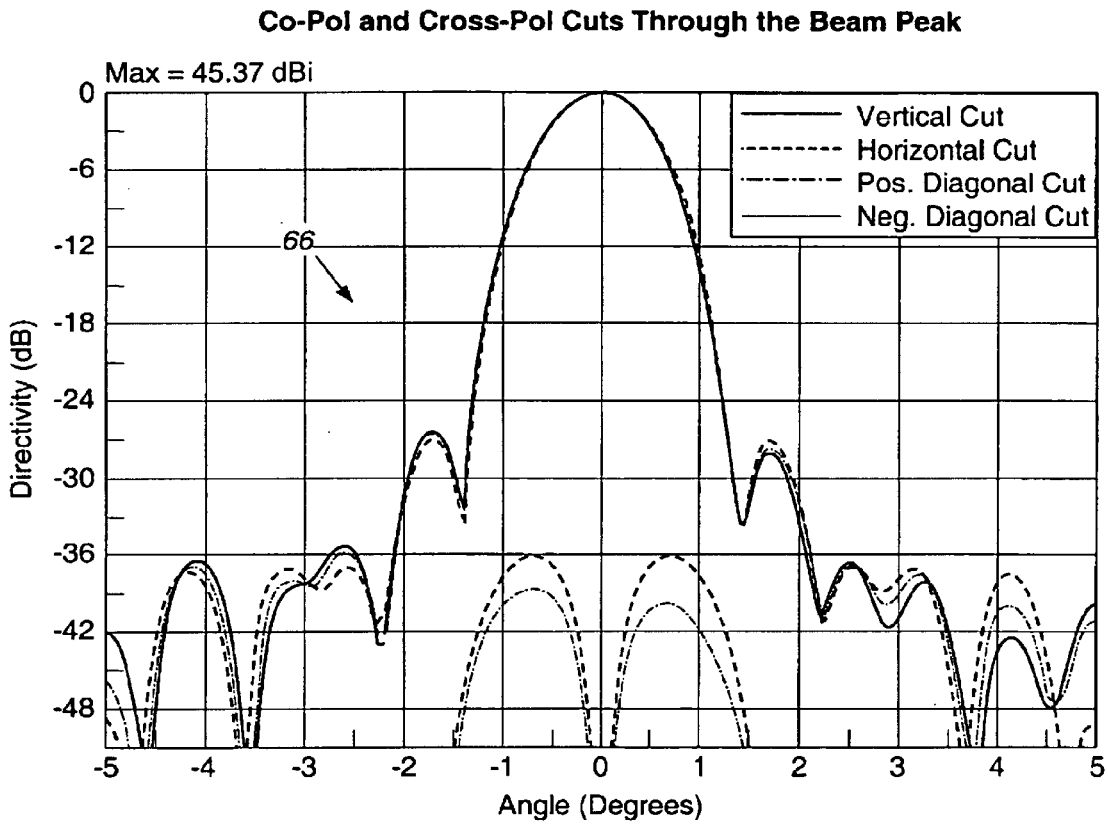
FIG. 12 is a graph of angle versus directivity of a radiation pattern of the high frequency antenna shown in FIG. 1.

FIGS. 11 and 12 show simulated radiation patterns 64, 66 of the low frequency (20.7 GHZ) antenna (reflector 12 and feed horn 16) and the high frequency (44.5 GHz) antenna (reflector 12, subreflector 14 and feed horn 18), respectively. As shown in FIG. 11, the half power beam width for the low frequency antenna was about 2.2° and the first side lobe occurred at about −24.5 dB. As shown in FIG. 12, the half power beam width for the high frequency signal was also about 1.1° and the first side lobe occurred at about −26 dB. These results show that the antenna system 10 is highly focused with minimum loss and maximum high and low frequency signal amplification.

As should now be appreciated, the antenna system 10 minimizes loss, and therefore maximizes antenna gain, for both the low and the high frequency signals it transmits/receives because there is no phase offset due to the placement of the focal points 30*a*, 30*b* of the subreflector 14 on the focal axis 20, thereby resulting in axial ratios of less than 1 dB and minimum defocus loss. Further, as shown in the table in FIG. 13, the isolation between the feed horns 16, 18 is a maximum value, and the beam squint pointing error is minimized with minimal design complexity and at an antenna efficiency greater than 60%.

While the above description is of the preferred embodiment of the present invention, the invention may be modified, altered, or varied without deviating from the scope and fair meaning of the following claims.

What is claimed is:

1. An antenna system comprising:

a low frequency antenna including a paraboloidal main offset reflector for reflecting a low frequency signal;

a high frequency antenna including both the main offset reflector and a hyperboloidal subreflector for reflecting a high frequency signal discrete from the low frequency signal, wherein the hyperboloidal subreflector includes a frequency selective surface for passing the low frequency signal reflected by the paraboloidal main offset reflector, and the paraboloidal main offset reflector is for outwardly reflecting the low frequency signal and for inwardly reflecting the high frequency signal, and the hyperboloidal subreflector is further for passing the low frequency signal to the paraboloidal main offset reflector, and for inwardly reflecting the high frequency signal from the paraboloidal main offset reflector.

2. An antenna system comprising:

a low frequency antenna including a paraboloidal main offset reflector for reflecting a low frequency signal;

a high frequency antenna including both the main offset reflector and a hyperboloidal subreflector for reflecting a high frequency signal discrete from the low frequency signal, wherein the hyperboloidal subreflector includes a frequency selective surface for passing the low frequency signal reflected by the paraboloidal main offset reflector, and the paraboloidal main offset reflector is for outwardly reflecting the high frequency signal and for inwardly reflecting the low frequency signal, and the hyperboloidal subreflector is further for passing the low frequency signal, and for outwardly reflecting the high frequency signal to the paraboloidal main offset reflector.

3. An antenna system comprising:

a low frequency antenna including a paraboloidal main offset reflector for reflecting a low frequency signal;

a high frequency antenna including both the main offset reflector and a hyqerboloidal subreflector for reflecting a high frequency signal discrete from the low frequency signal, wherein the hyqerboloidal subreflector includes a frequency selective surface for passing the low frequency signal reflected by the paraboloidal main offset reflector, and the low frequency antenna includes a first feed horn for one of transmitting and receiving the low frequency signal, and the high frequency antenna includes a second feed horn for one of transmitting and receiving the high frequency signal, wherein each of the first and second feed horns comprises a smooth-walled three-section flared feed horn having a polarizer for circular polarization.

4. The antenna system of claim 3, wherein the first and second feed horns are positioned to tune out beam squint pointing error between the high and low frequencies.

5. The antenna system of claim 4, wherein the first feed horn is positioned at a focal point of the paraboloidal main offset reflector, and the second feed horn is positioned at one focal point of the hyperboloidal subreflector.

6. The antenna system of claim 5, wherein both the first and second feed horns are positioned on a focal axis of the main offset reflector.

7. A dual band antenna system comprising:

a first feed for transmitting a low frequency signal;

a second feed for receiving a high frequency signal discrete from the low frequency signal transmitted by the first feed;

a main offset reflector for outwardly reflecting the low frequency signal transmitted by the first feed and for inwardly reflecting the high frequency signal to the second feed;

a subreflector for passing the low frequency signal transmitted from the first feed to the main offset reflector, and for reflecting the high frequency signal from the main offset reflector to the second feed;

wherein the first and second feeds are positioned to tune out beam squint pointing error between the high and low frequency signals.

8. The dual band antenna system of claim 7, wherein the subreflector is sized in a range of approximately 10–20λ, where λ represents a wavelength of the high frequency signal, and has a feed taper of at least approximately −15 dB with respect to the high frequency signal.

9. The dual band antenna system of claim 8, wherein the subreflector is sized in a range of approximately 12–15λ with respect to the high frequency signal.

10. The dual band antenna system of claim 9, wherein the first feed is for transmitting an SHF band signal, and the second feed is for receiving an EHF band signal.

11. The dual band antenna system of claim 10, wherein the half-power bandwidth of the first feed is about 2.2°.

12. The dual band antenna system of claim 7, wherein the first and second feeds comprise smooth-walled three-section flared feed horns each having a polarizer for circular polarization.

13. The dual band antenna system of claim 7, wherein the first feed is positioned at a focal point of the main offset reflector to maximize antenna gain for the low frequency signal, and the second feed is positioned at one focal point of the subreflector to maximize antenna gain for the high frequency signal.

14. The dual band antenna system of claim 7, wherein the subreflector has an associated feed loss of about 0.3 dB.

15. The dual band antenna system of claim 7, wherein the first and second feeds are positioned at the focal point of the reflector and the subreflector, respectively.

16. A dual band antenna system comprising:

a first feed for receiving a low frequency signal;

a second feed for transmitting a high frequency signal discrete from the low frequency signal received by the first feed;

a main offset reflector for outwardly reflecting the high frequency signal transmitted by the second feed and for inwardly reflecting the low frequency signal to the first feed;

a subreflector for reflecting the high frequency signal transmitted from the second feed to the main offset reflector, and for passing the low frequency signal from the main offset reflector to the first feed;

wherein the first and second feeds are positioned to tune out beam squint pointing error between the high and low frequency signals.

* * * * *